United States Patent [19]

Ross

[11] 4,011,723

[45] Mar. 15, 1977

[54] FLUID POWER SYSTEM

[76] Inventor: James J. Ross, 28715 Barkman, Roseville, Mich. 48066

[22] Filed: June 28, 1974

[21] Appl. No.: 484,342

[52] U.S. Cl. ..... 60/486; 60/325; 417/403; 417/346; 60/431

[51] Int. Cl.[2] ..... F05B 11/16

[58] Field of Search ..... 60/431, 486, 325; 417/346, 379, 401, 403, 404

[56] References Cited

UNITED STATES PATENTS

| | | | |
|---|---|---|---|
| 2,370,526 | 2/1945 | Doran | 60/483 X |
| 2,867,974 | 1/1959 | Wenander | 417/379 |
| 2,938,347 | 5/1960 | Sturgis | 60/325 UX |
| 2,984,985 | 5/1961 | MacMillin | 60/471 |
| 3,135,210 | 6/1964 | English | 417/347 |
| 3,201,031 | 8/1965 | Maglott | 417/404 X |
| 3,214,901 | 11/1965 | Iverson | 60/431 |

FOREIGN PATENTS OR APPLICATIONS

| | | | |
|---|---|---|---|
| 642,765 | 12/1947 | United Kingdom | 417/346 |

*Primary Examiner*—Allen M. Ostrager
*Attorney, Agent, or Firm*—Irving M. Weiner; Pamela S. Austin; Melvin Yedlin

[57] ABSTRACT

A fluid power system comprising a steam generator connected to a hydraulic pumping device for delivering steam under pressure to the device for driving the same, while steam is returned to the steam generator via a condenser. The hydraulic pumping device is connected by means of suitable conduits to a plurality of hydraulic motors for driving the same and the conduits include valving means for controlling the direction of fluid between the hydraulic pumping device and the hydraulic motors and returning fluid to a reservoir from which fluid is initially drawn by the hydraulic pumping device. The hydraulic motors provide a rotary output for driving the wheels of a vehicle on which the fluid power system is used. The system further comprises valve means for controlling the pressure at which the system operates. A single directional hydraulic motor is connected to the output of the hydraulic pumping device through a variable flow control valve and a pressure regulating valve and functions to provide power for operating generators, power brakes, steering, air-conditioning and other systems which are utilized in conjunction with the fluid power system.

2 Claims, 3 Drawing Figures

FLUID POWER SYSTEM

BACKGROUND OF THE INVENTION

1. Field of the Invention

The present invention relates generally to fluid power systems, and particularly, to a hydraulically powered system which utilizes steam for driving a hydraulic pumping device generating the hydraulic pressure necessary to operate the system.

2. Description of the Prior Art

Various systems have been disclosed in the prior art such as in the U.S. Pat. Nos. 2,508,298, 2,881,706, 3,135,210, 3,179,056, 3,282,167 and 3,073,108 that comprise pumping devices having pistons that are driven in both directions by a first fluid medium and which, in turn, function to generate fluid under pressure to drive one or more hydraulic motors. None of these patents disclose a system which utilizes steam generated by external combustion for the purpose of driving a hydraulic device while functioning in a low pollution environment yet generating sufficient power to move a vehicle with high efficiency due to a novel means for sensing the load requirements of the vehicle and controlling the output of the steam generator.

SUMMARY OF THE INVENTION

The present invention which will be described subsequently in greater detail comprises a fluid power system utilizing a steam operated hydraulic pump connected through suitable valving to hydraulic motors wherein the steam generated by an external combustion means is utilized as the driving force for generating hydraulic pressure which, in turn, drives the hydraulic motors. The valving and control means are utilized to control the directional movement of the hydraulic motors whilst sensing means are provided for determining the load requirements of the vehicle to coordinate the output of the steam generator such that the steam generator's output is a function of load requirement.

It is therefore an object of the present invention to provide a new and improved fluid power system wherein a steam generator is utilized to generate steam under pressure for driving a hydraulic pumping device which, in turn, is adapted to drive a plurality of hydraulic motors.

It is a further object of the present invention to provide such a system which is efficient, simple to construct, and thus, inexpensive to manufacture and operate.

Other objects, advantages and applications of the present invention will become apparent to those skilled in the art of fluid power systems and, in particular, those skilled in the art of steam driven hydraulic pumping devices when the accompanying description of one example of the best mode contemplated for practicing the invention is read in conjunction with the accompanying drawings.

BRIEF DESCRIPTION OF THE DRAWINGS

The description herein makes reference to the accompanying drawings wherein like references numerals refer to like parts throughout the several views and in which.

DESCRIPTION OF THE PREFERRED EMBODIMENT

Figure 1:
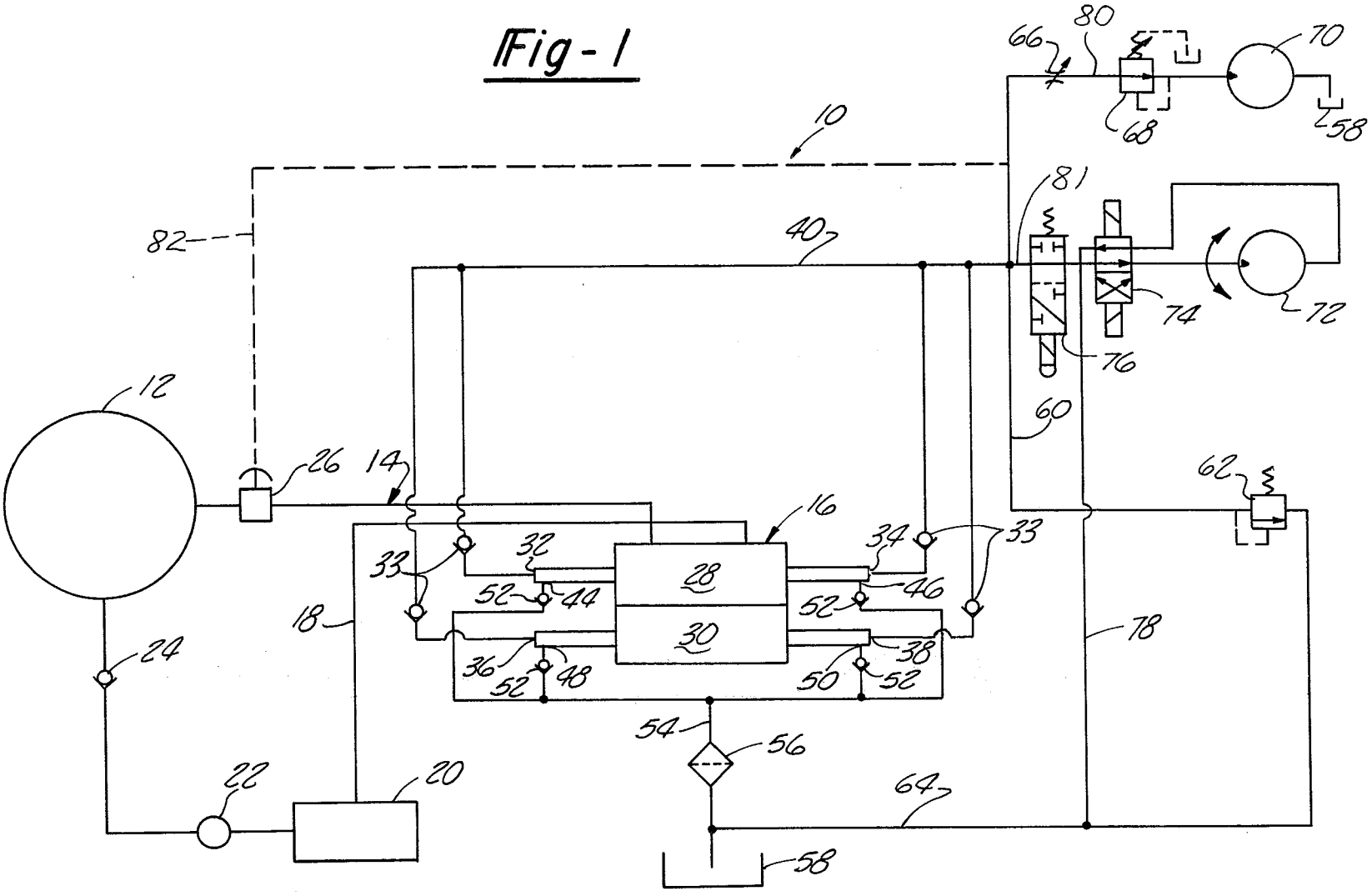
FIG. 1 is a schematic diagram of a fluid power circuit constructed in accordance with the principles of the present invention.

Referring now to the drawings and, in particular, to FIG. 1 there is illustrated a schematic diagram of one example of a fluid power system 10 comprising a steam generator 12 having an output which is connected by means of a first conduit 14 to the inlet of a steam driven hydraulic pumping device 16. The hydraulic pumping device 16 has an outlet which is connected by means of a second conduit 18 to a condenser 20 for return to the steam generator 12 via a pump 22 and a check valve 24. The conduit 14 further comprises a steam pressure control valve 26 which is adapted to control the amount of steam under pressure generated and delivered by the steam generator 12. However, the valve 26 will be discussed in further detail hereinafter.

The hydraulic pumping device 16 will be described in greater detail hereinafter, however, it should be noted that the pumping device 16 comprises two piston or pumping sections 28 and 30. The pumping section 28 has outlet ports 32 and 34 while the pumping section 30 has outlet ports 36 and 38. All of the outlet ports 32 through 38 are connected to a main flow conduit 40 via a plurality of check valves 33 which prevent the back flow of fluid from the main conduit 40 back into the pumping sections 28 and 30, as will be described in greater detail hereinafter. The pumping section 28 further comprises inlet ports 44 and 46 while the pumping section 30 has inlet ports 48 and 50. The inlet ports all communicate via associated check valves 52 with a main return conduit 54 which communicates through a filter 56 to a main reservoir 58. The main conduit 40 branches into three conduits, namely, an auxiliary power conduit 80, a main power circuit conduit 81 and a relief valve conduit 60. The relief conduit 60 includes a conventional relief valve 62 operable to limit the maximum pressure in the conduit 40 and is so designed as to open and communicate the conduit 40 to the reservoir 58 via a conduit 64 when the pressure in the conduit 40 exceeds some predetermined limit. The auxiliary power conduit 80 is connected via a variable flow control valve 66, and a pressure regulating valve 68 to a fixed displacement second rotary hydraulic motor 70 which, in turn, has an outlet that returns fluid to the reservoir 58. The fixed displacement hydraulic motor 70 functions to provide power for the vehicle upon which the present system is designed to be used. For example, the motor 70 may provide power for operating components, such as a generator, power brakes, steering, air-conditioning, the return pump 22 and other auxiliary items, as desired.

The main conduit 81 includes a plurality of first rotary hydraulic motors 72 which have inlet and outlet ports that are selectively connected to the main hydraulic line 40 by means of a directional control valve 74 and an acceleration valve 76. The directional control valve 74 selectively controls the flow of fluid to the motor ports of the hydraulic motors 72 and then returns the fluid to the reservoir 58 via a conduit 78. By proper actuation of the directional control valve 74, the direction of flow from the main conduit 40 to the ports of the hydraulic motor 72 may be controlled, and thus, the direction of rotation of the output shafts of the motors 72 may be controlled. The output shafts of the hydraulic motors 72 are adapted to be connected by any suitable means to the driving wheels of the vehicle upon which this system is designed to be utilized and by proper control of the directional control valve 74 the vehicle wheels may be reversed such that the vehicle may go forwardly or rearwardly as desired. The acceleration valve controls the rate of fluid flow through the system 10 and controls the speed of the motors 72, and thus, the speed at which the vehicle is propelled. The aforementioned sensing means, such as a pilot line 82, is provided to coordinate the output of the steam generator so that such output is a function of load requirement. The pilot line 82 can activate the valve 26 depending on the resistance or load met by motors 72, thus using only as much steam pressure as is needed to move the vehicle at any given instant.

Figure 2:
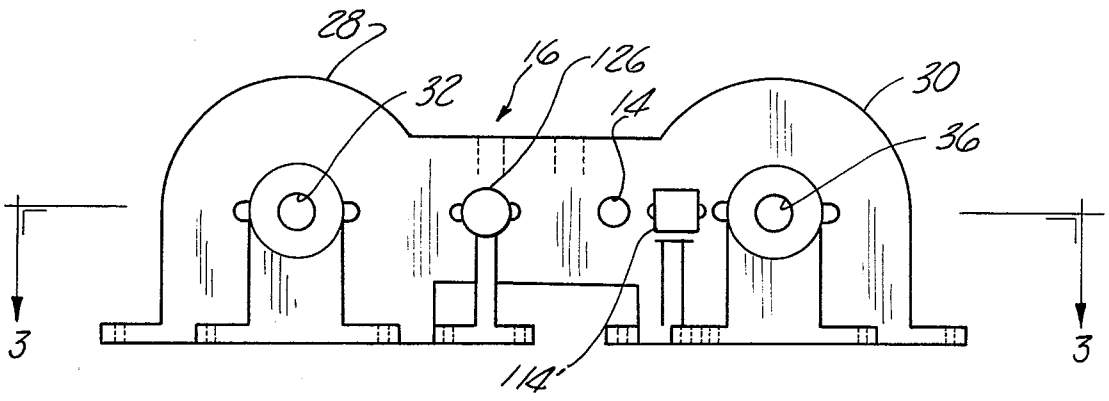
FIG. 2 is a side elevational view of a steam driven hydraulic pumping device constructed in accordance with the principles of the present invention.
Figure 3:
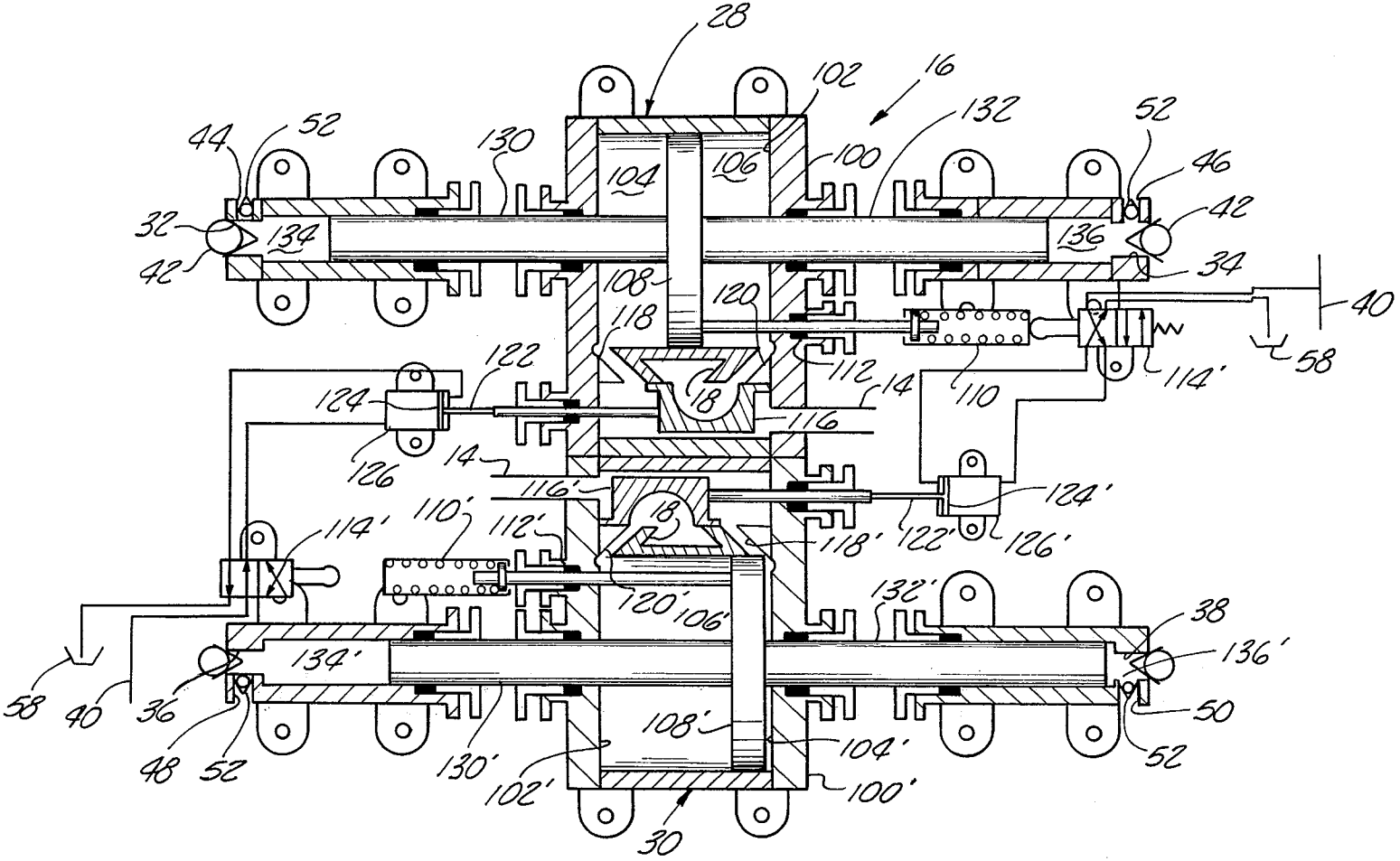
FIG. 3 is a schematic cross-sectional view of the steam driven hydraulic pumping device taken along line 3—3 of FIG. 2.

Referring now to FIG. 2 and 3 for a description of the steam driven hydraulic pumping device 16 for a more detailed explanation of the manner in which steam from the steam generator 12 is utilized to generate fluid under pressure for driving the motors 72.

As aforementioned, the hydraulic pumping device 16 comprises two pumping sections 28 and 30 and since the two pumping sections 28 and 30 are substantially identical, only the pumping section 28 will be described in detail herein. However, it should be understood that the numerals assigned to the pumping section 28 will be utilized to describe the corresponding components in the pumping section 30 it being understood that the pumping section 28 is a mirror image of the pumping section 38 and those elements of the pumping section 30 will be described by the same numeral having a "prime" thereafter.

As can best be seen in FIG. 3, pumping section 28 comprises a housing section 100 having a first chamber or bore 102 which is subdivided into pressure chambers 104 and 106 by means of a reciprocally mounted first piston 108, having a spring loaded rod 110 extending from one surface through suitable seals 112 for selected engagement with the actuating lever of a four way valve 114. The mechanism 28 further comprises a slide valve 116 which is reciprocal in such a manner as to selectively permit communication of the steam from the inlet conduit 14 through passages 118 and 120 so as to selectively and respectively communicate steam to the pressure chambers 104 and 106 on opposite sides of the piston 108. It can be seen that when the slide valve 116 is in the position illustrated, steam under pressure from the inlet conduit 14 flows through the passageway 118 into the pressure chamber 104 exerting a force on the piston 108 to move the same rightwardly whereas fluid within the chamber 106 is exhausted via the passageway 120 through the slide valve 116 and out the exhaust conduit 18. Movement of the slide valve 116 is accomplished by means of a rod 122 that extends outwardly from slide valve 116 and is connected to a reciprocally mounted piston 124 within a cylinder 126. The opposite sides of the cylinder 126 are alternately communicated with steam under pressure from the conduit 14 when a valve 114' is shifted by means of the spring loaded rod 110. Similarly, the slide valve 116' is connected to a rod 122' which, in turn, is operated by a piston 124' of a cylinder 126' that is, in turn, operatively connected to fluid under pressure by means of the valve 114 of the piston assembly 28. The piston 108 has piston means, such as rods 130 and 132 which extend outwardly from opposite sides of the piston 108 into third and fourth pressure chambers, such as smaller pressure chambers 134 and 136, respectively. It can be seen that if the piston 108 is shifted rightwardly in the aforementioned manner the pressure chamber 136 is pressurized such as to force fluid therein from the outlet port 34 and past the check valve 42 into the main conduit 40 in the aforementioned manner. Similarly, as the piston 108 is reciprocated leftwardly as can be seen in FIG. 3, fluid is being drawn into the port 44 past check valve 52. As the direction of reciprocal movement of the piston 108 is reversed by means of the shifting of the slide valve 116 to the left because of the pressurization of steam acting on the right side of the piston 124 in cylinder 126, the fluid in chamber 134 will be compressed by the piston rod 130 and fluid forced out under pressure through the port 32 past check valve 42 and into the main conduit 40.

Similarly, the piston section 30 will operate in a manner similar to that described with respect to the piston section 28 whereby fluid is being constantly drawn into the third and fourth chambers 134, and 136, and seventh and eighth chambers 134' and 136' during movement of the piston rods in one direction which causes expansion of these chambers while fluid is delivered under pressure from these chambers when the piston rods are reciprocated in an opposite direction.

It can thus be seen that the present invention has provided a new and simple design for converting steam energy into hydraulic energy and which, in turn, is utilized as a means for driving a vehicle.

Although only one example of the present invention has been disclosed, it should be understood by those skilled in the art of fluid power systems that other forms may be had, all coming within the spirit of the invention and the scope of the appended claims.

What is claimed is as follows:

1. A fluid power system comprising, in combination:

a steam generator (12) and a first conduit means (14) connecting the steam generator (12) to a steam driven hydraulic pump (16);

said steam driven hydraulic pump (16) comprising a housing (100,100') having a first bore (102) within which is reciprocally mounted a first piston (108) dividing said first bore (102) into opposing first and second chambers (104, 106) alternately communicable with said steam generator (12); valve means (116) for selectively communicating said steam generator (12) to said opposing first and second pressure chambers (104, 106) so as to reciprocate said first piston (108) within said first bore (102); said first piston (108) having oppositely-extending coaxially disposed first and second piston means (130,132), the outer ends of which are disposed for reciprocal movement in opposing third and fourth pressure chambers (134,136) and which alternately compress and expand fluid therein for delivering pressurized fluid from one of said third and fourth pressure chambers (134,136) while fluid is drawn into the other of said third and fourth pressure chambers (134,136); a second bore (102') disposed in said housing (100,100'); said second bore (102') containing a second piston (108') which divides said second bore (102') into opposing fifth and sixth pressure chambers (104', 106') that are communicable with said steam generator (12); valve means (116') for communicating said opposing fifth and sixth pressure chambers (104', 106') that are communicable with said steam generator (12); said second piston (108') having opposing coaxially extending piston means (130', 132') reciprocally operable in opposing seventh and eighth pressure chambers (134', 136') for alternately compressing and expanding fluid therein to deliver fluid under pressure from one of said opposing fifth and sixth pressure chambers (104', 106') while the other of said opposing fifth and sixth pressure chambers (104', 106') receives fluid at a low pressure; third means (110, 112, 114, 122', 124', 126') associated with said first piston in said first mentioned bore (102) which are operable to actuate the valve (116') associating with said second mentioned piston (108') to communicate pressure to a select one of the fifth and sixth pressure chambers (104', 106') associated therewith; and fourth means (110', 112', 114', 122, 124, 126) associated with said second piston (108') which are operable upon actuation and after a selected movement of said second piston (108') for operating said first mentioned valve (116) with selectively communicating fluid under pressure to one of said pressure chambers (104, 106) associated with said first mentioned piston (108) whereby said first and second pistons (108, 108') are reciprocable in opposite directions for delivering fluid under pressure to a plurality of fluid circuits;

said fluid power system further comprising second conduit means (18) connecting the steam driven hydraulic pump (16) to said steam generator (12) via a condenser (20);

a first fluid circuit (81) connecting the hydraulic output of said steam driven hydraulic pump (16) to a plurality of first rotary bidirectional hydraulic motors (72);

first means (74) disposed between said hydraulic pump output and said first rotary bidirectional hydraulic motors (72) for controlling the direction of flow between said steam driven hydraulic pump (16) and said first rotary bidirectional hydraulic motors (72) and a reservoir (58) to which the inlet of said steam driven hydraulic pump (16) is connected;

a second fluid conduit (60) comprising a relief valve (62) for limiting the pressure at which fluid is delivered from said steam driven hydraulic pump (16), the outlet of said relief valve (62) being connected to said reservoir (58); and a third fluid conduit (80) comprising a pressure regulating valve (68) and a variable flow control valve (66) for maintaining the pressure and rate of flow of fluid to a second rotary hydraulic motor (70) at a predetermined value; and second means (82, 26) disposed between said fluid circuits (81, 60, 80) and said steam generator (12) for sensing the load on said plurality of first rotary bidirectional hydraulic motors (72) for controlling the steam generated by said steam generator (12).

2. A fluid power system defined in claim 1 wherein said steam generator (12) by said conduit means (14) is connected to said steam driven hydraulic pump (16) which by said first fluid circuit (81) is connected to said plurality of rotary bidirectional motors (72) which provide a rotary output for driving the wheels of a vehicle.

* * * * *